US005647751A

United States Patent [19]

Shulman et al.

[11] Patent Number: 5,647,751

[45] Date of Patent: Jul. 15, 1997

[54] FEMALE RECEPTACLE AND PREMOLD THEREFOR

[76] Inventors: Michael Y. Shulman, 715 Opatut Ct., Toms River, N.J. 08753; Yook K. Chan, 48 Mercury Cir., South Amboy, N.J. 08879; Henry F. Skoczylas, 524 Jessica La.; Suzanne V. Hickey, 1472 Green Grove Rd., both of Brick, N.J. 08724; Nicholas K. Katzenberger, 540 Seawaneka Ave., Oceanport, N.J. 07757

[21] Appl. No.: 532,934

[22] Filed: Sep. 22, 1995

Related U.S. Application Data

[63] Continuation-in-part of Ser. No. 497,201, Jun. 30, 1995, abandoned.

[51] Int. Cl.[6] ..... H01R 13/504

[52] U.S. Cl. ..... 439/106; 439/606

[58] Field of Search ..... 439/106, 606, 439/686, 695

[56] References Cited

U.S. PATENT DOCUMENTS

| | | | |
|---|---|---|---|
| 3,611,257 | 10/1971 | Carkhuff | 439/606 |
| 3,750,086 | 7/1973 | Iversen . | |
| 3,891,289 | 6/1975 | Hanke . | |
| 4,043,630 | 8/1977 | Suverison et al. | 439/606 |
| 4,867,697 | 9/1989 | Borges | 439/265 |
| 4,909,749 | 3/1990 | Long | 439/263 |
| 5,170,117 | 12/1992 | Chio | 324/158 F |
| 5,176,545 | 1/1993 | Brown | 439/885 |
| 5,181,866 | 1/1993 | Jerome et al. | 439/850 |
| 5,217,388 | 6/1993 | Brown | 439/606 |
| 5,234,355 | 8/1993 | Sosinski et al. | 439/337 |
| 5,282,753 | 2/1994 | Su | 439/106 |
| 5,338,218 | 8/1994 | Haas | 439/346 |
| 5,411,403 | 5/1995 | Blanche | 439/106 |
| 5,474,459 | 12/1995 | Su | 439/106 |

*Primary Examiner*—Gary F. Paumen
*Attorney, Agent, or Firm*—Selitto & Associates

[57] ABSTRACT

A female receptacle adapted for electrical connection to a male plug includes a premold for housing a pair of clothes-pin type metal female contacts and a D-shaped metal female pin. The premold, which may be made from a relatively rigid material, is housed within an overmold made from a less rigid material. The premold can be of a locking variety or a non-locking variety.

22 Claims, 9 Drawing Sheets

FEMALE RECEPTACLE AND PREMOLD THEREFOR

CROSS REFERENCE TO RELATED APPLICATION

This is a continuation-in-part of application Ser. No. 08/497,201 filed Jun. 30, 1995, now abandoned.

FIELD OF THE INVENTION

The present invention relates to female electrical receptacles and, more particularly, to such receptacles which are adapted for electrical connection to a male plug and which are equipped with a pair of clothes-pin type metal female contacts and a D-shaped metal female pin.

BACKGROUND OF THE INVENTION

Over the years, various female receptacles for making electrical contact with a male plug have been developed. One type, which is especially useful as a female receptacle on an extension cord, includes an overmold which houses a pair of clothes-pin type metal female contacts and a D-shaped metal female pin. The female contacts and the female pin are typically mounted within the overmold by positioning the female contacts and the female pin in a cavity of a mold and then overmolding them with a suitable material, such as vinyl.

In operation, as the female contacts receive male pins of an associated male plug, the female contacts expand and, as a result, are urged directly against the overmold. The overmold, in turn, urges the female contacts against the male pins such that the female contacts grip the male pins. In order to provide sufficient gripping force, the overmold is typically made from a vinyl having a relatively high durometer measurement (i.e., in a range of from about 90 durometer to about 95 durometer).

The female receptacle of the type described above has numerous disadvantages compared to its wall-mounted counterpart. For instance, while the durometer measurement of the vinyl typically ranges from about 90 durometer to about 95 durometer, the overmold of the female receptacle is relatively flexible. As a result, the spacial relationship of the female contacts and the female pin may not remain fixed (i.e., they are movable relative to one another), thereby presenting the possibility that the female receptacle may fail to exert a sufficient gripping force on the male plug engaged therewith. Obviously, such a condition may have a detrimental affect on the performance characteristics and the useful operating life of the female receptacle.

It is common knowledge that the durometer measurement of vinyl varies substantially in response to a change in temperature. As a result, when a female receptacle is overmolded with a vinyl material, the insertion force and retraction force for an associated male plug may vary substantially in response to temperature changes. For instance, the rigidity of vinyl increases at low temperatures, and, as a result, insertion and retraction of a male plug into and from a vinyl overmolded female receptacle may be more difficult at such temperatures. In contrast, the flexibility of vinyl increases at high temperatures, and, as a result, a vinyl overmolded female receptacle may not exert sufficient gripping force upon a male plug at such temperatures.

A further disadvantage results from the fact that molding material can flash into the female contacts during the molding process. Such flashing may create a discontinuity between the female contacts and their corresponding male pins of a male plug, thereby creating the possibility of a short circuit.

SUMMARY OF THE INVENTION

The present invention overcomes the disadvantages and shortcomings of the prior art discussed above by providing a new and improved female receptacle which is equipped with a unique premold adapted to house a pair of clothes-pin type metal female contacts and a D-shaped metal female pin. More particularly, the premold includes a body which receives the female contacts and the female pin and which maintains them in a desired spacial relationship relative to each other. A cover is releasably mounted on the body such that the cover and the body cooperate to form an enclosure for the female contacts and the female pin, whereby molding material for a surrounding overmold is inhibited from entering the premold and hence flashing into the contacts and the pin during an overmolding operation. The premold is also designed such that the female contacts will exert substantially constant gripping force on the corresponding male pins of an associated male plug. If additional gripping force is required, the premold may be provided with a locking mechanism adapted to urge the female contacts into locking engagement with their corresponding male pins. When the premold is made from a relatively rigid or hard plastic, such as nylon, the overmold can be made of vinyl having a durometer measurement of about 80 durometer or less.

BRIEF DESCRIPTION OF THE DRAWINGS

For a more complete understanding of the present invention, reference is made to the following detailed description of two exemplary embodiments considered in conjunction with the accompanying drawings, in which.

DESCRIPTION OF THE EXEMPLARY EMBODIMENTS

Figure 1:
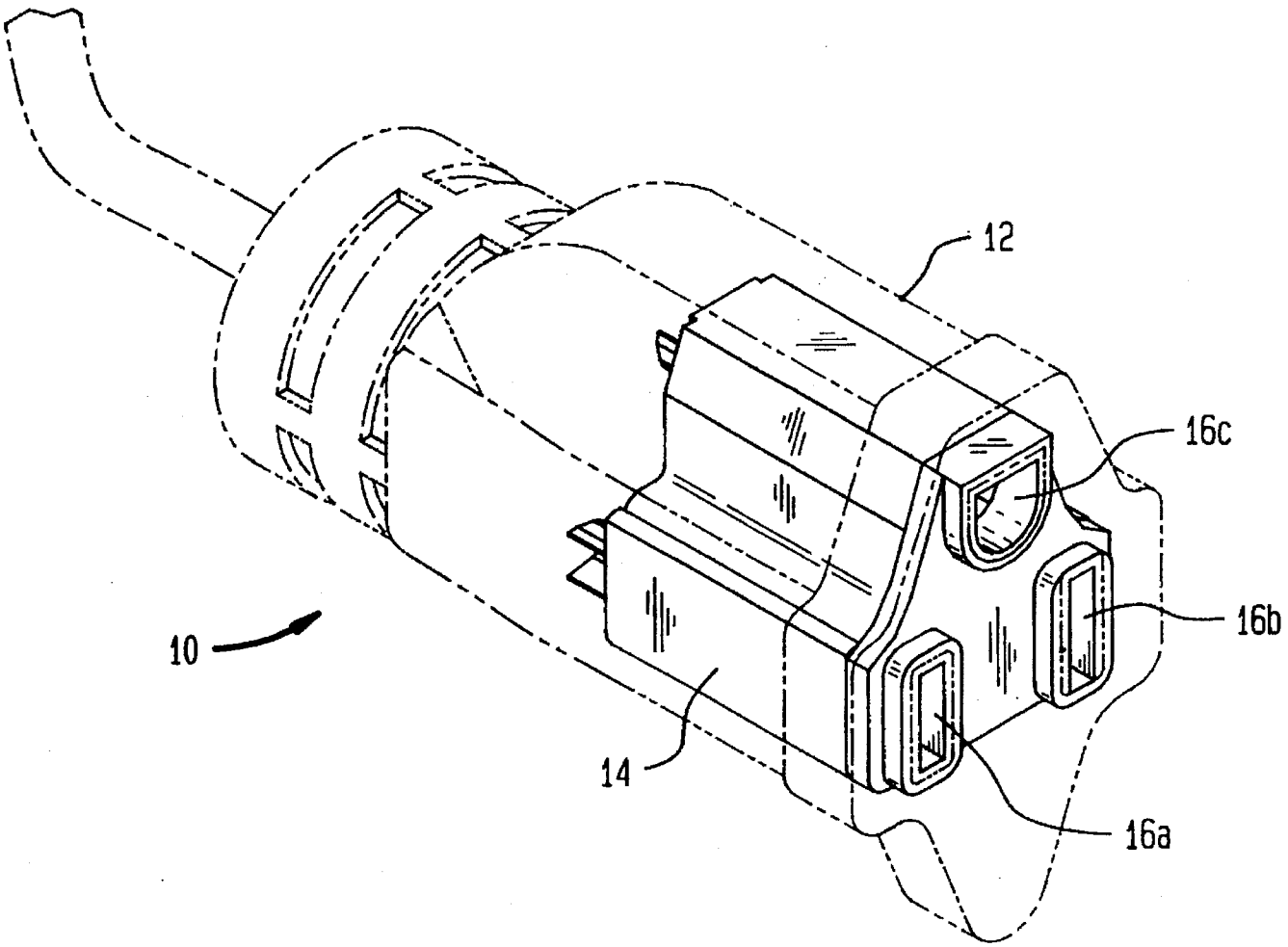
FIG. 1 is a from perspective view, looking from above, of a female receptacle constructed in accordance with a first embodiment of the present invention, an overmold portion of the female receptacle being shown in phantom to facilitate consideration and discussion.

With reference to FIG. 1, a female receptacle 10 constructed in accordance with a first embodiment of the present invention includes an overmold portion 12 (shown in phantom in FIG. 1) and a premold housing 14 positioned within the overmold portion 12. The overmold portion 12 is made of a vinyl material or the like having a durometer measurement (e.g., about 80 durometer or less) which is lower than that of an overmolding for a conventional female receptacle without a premold. The premold housing 14 is made of nylon and is therefore substantially rigid, at least in comparison to the overmold portion 12. The female receptacle 10 also includes openings 16*a*, 16*b*, 16*c* shaped and sized to receive a pair of male pins and a ground pin, respectively, of a compatible male plug (not shown).

Figure 2:
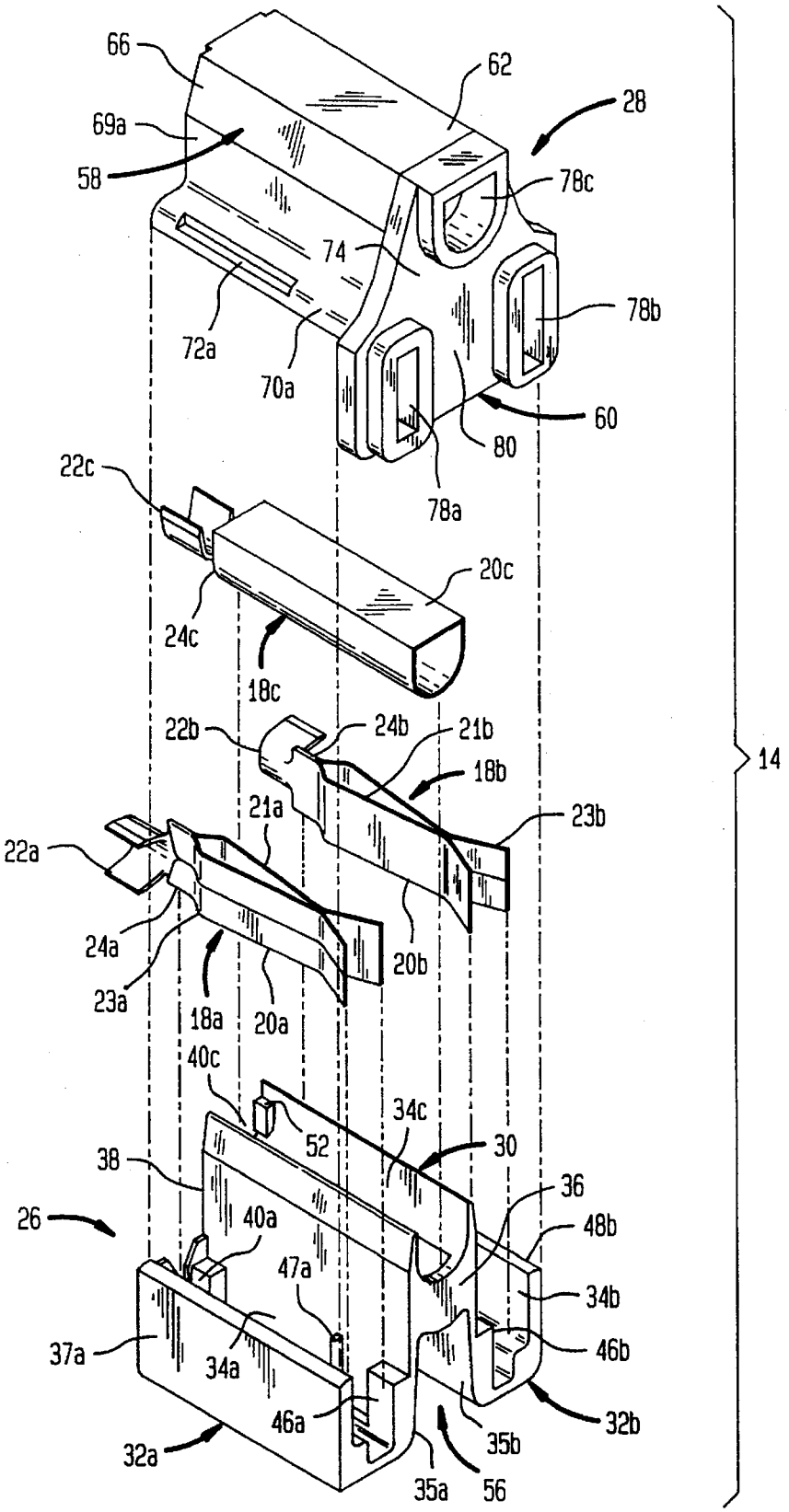
FIG. 2 is an exploded perspective view, looking from above, of a premold housing employed by the female receptacle shown in FIG. 1.

Referring to FIG. 2, a pair of clothes-pin type metal female contacts 18*a*, 18*b* and a D-shaped metal female pin 18*c* are housed within the premold housing 14, which maintains a predetermined spacial relationship between the female contacts 18*a*, 18*b* and the female pin 18*c* due to its rigidity. While the female contacts 18*a*, 18*b* and the female pin 18*c* are conventional, their construction will be discussed further hereinafter in order to facilitate consideration and discussion of the present invention.

With reference to FIG. 2, the female contacts 18*a*, 18*b* have male pin engaging portions 20*a*, 20*b*, respectively, which are shaped and sized to engage male pins of a compatible male plug and which have inner legs 21*a*, 21*b*, respectively, and outer legs 23*a*, 23*b*, respectively. The female contacts 18*a*, 18*b* also have crimp ends 22*a*, 22*b*, respectively, as well as flat connecting portions 24*a*, 24*b*, respectively, which connect the engaging portions 20*a*, 20*b*, respectively, to the crimp ends 22*a*, 22*b*, respectively.

Referring still to FIG. 2, the female pin 18*c* is provided with a male pin engaging portion 20*c*, which is shaped and sized to engage a ground pin of a compatible male plug, and a crimp end 22*c*. The female pin 18*c* also has an arcuate connecting portion 24*c* connecting the engaging portion 20*c* and the crimp end 22*c* (see FIGS. 11 and 12).

Figure 3:
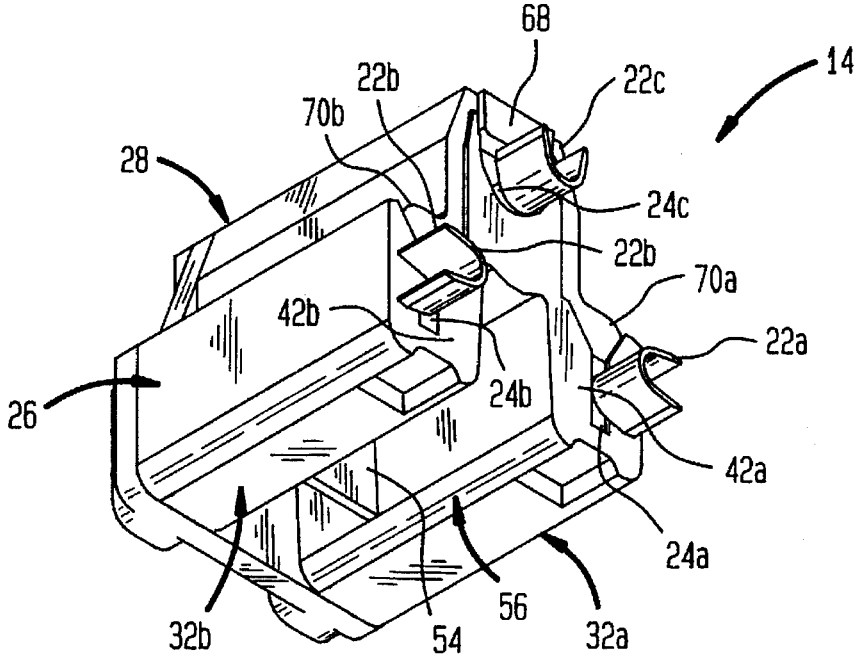
FIG. 3 is a rear perspective view, looking from below, of the premold housing shown in FIGS. 1 and 2.
Figure 4:
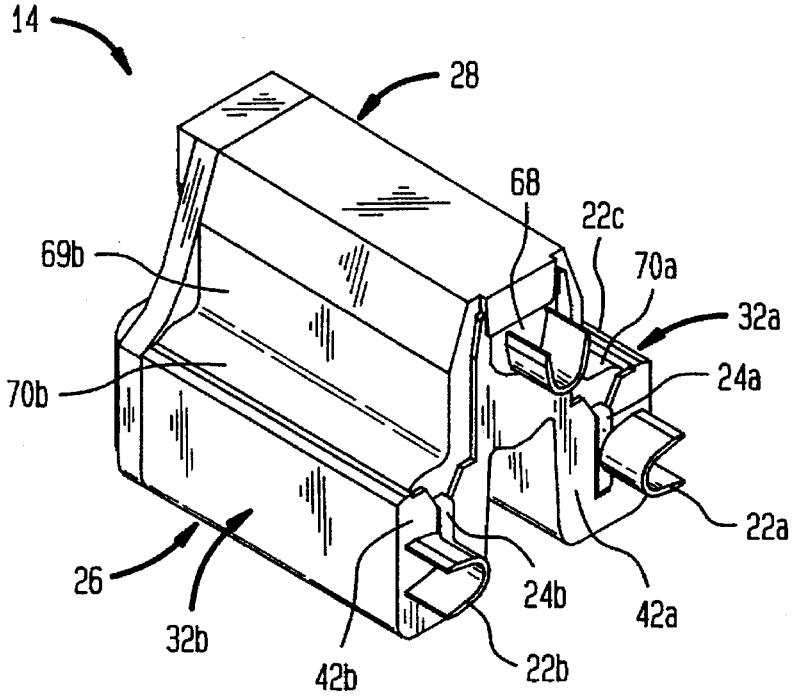
FIG. 4 is a rear perspective view, looking from above, of the premold housing shown in FIGS. 1 and 2.

Referring now to FIGS. 2–4, the premold housing 14 is defined by a body 26 and a cover 28 mounted on the body 26. More particularly and with reference to FIGS. 2 and 8–10, the body 26 includes a central portion 30 and opposing side portions 32*a*, 32*b*, which depend from opposing sides of the central portion 30. The side portions 32*a*, 32*b* include troughs 34*a*, 34*b*, respectively, extending from a front end 36 of the body 26 to a rear end 38 of the body 26. The troughs 34*a*, 34*b* are sized and shaped so as to receive the engaging portions 20*a*, 20*b*, respectively, of the female contacts 18*a*, 18*b*, respectively.

Figure 11:
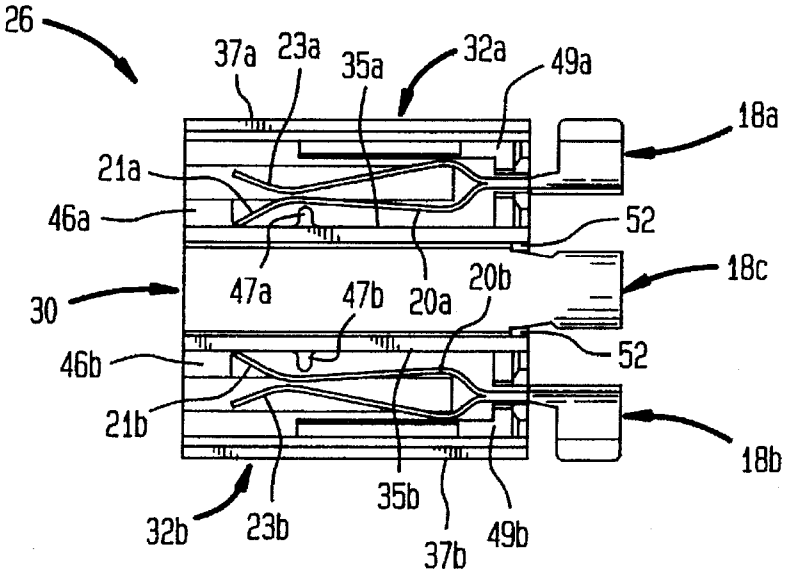
FIG. 11 is similar to FIG. 9, except that female contacts are positioned in the body.

As shown in FIG. 11, the engaging portions 20*a*, 20*b* are oriented in the troughs 34*a*, 34*b* in a predetermined contracted position in which the outer legs 23*a*, 23*b* are resiliently biased into contact with their corresponding inner legs 21*a*, 21*b*. In such a position, which is assumed when the female contacts 18*a*, 18*b* are out of engagement with the male pins of a compatible male plug, the engaging portions 20*a*, 20*b* are slightly skewed inwardly such that the free ends of the inner legs 21*a*, 21*b* are in contact with inner walls 35*a*, 35*b*, respectively, of the side portions 32*a*, 32*b*, respectively, and such that the free ends of the outer legs 23*a*, 23*b* are out of contact with outer walls 37*a*, 37*b*, respectively, of the side portions 32*a*, 32*b*.

Figure 12:
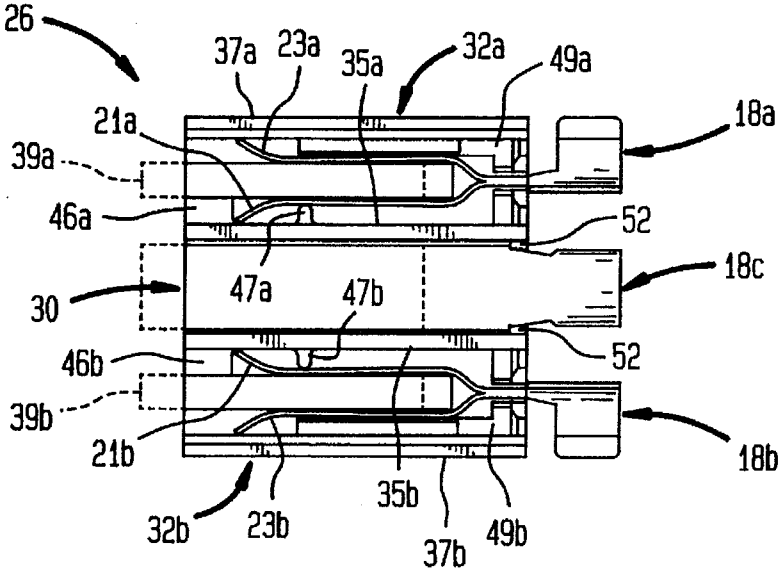
FIG. 12 is similar to FIG. 11, except that the female contacts are in an expanded position assumed when they are engaged by male pins of compatible male plug.
Figure 15:
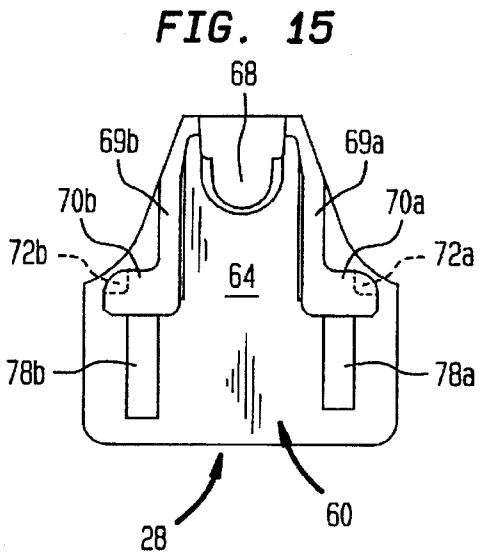
FIG. 15 is a rear elevational view of the cover shown in FIG. 13.
Figure 14:
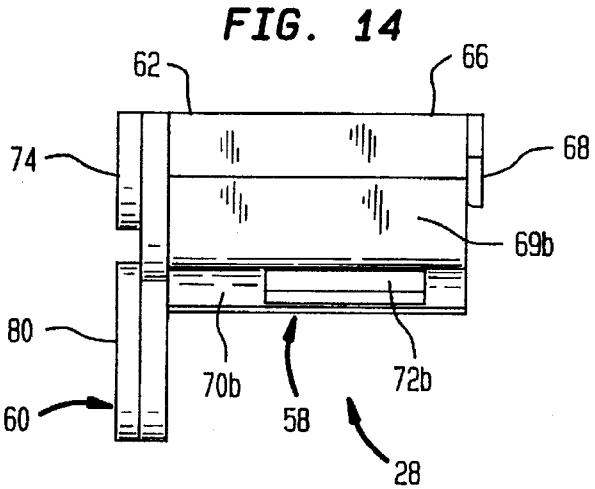
FIG. 14 is a side elevational view of the cover shown in FIG. 13.
Figure 16:
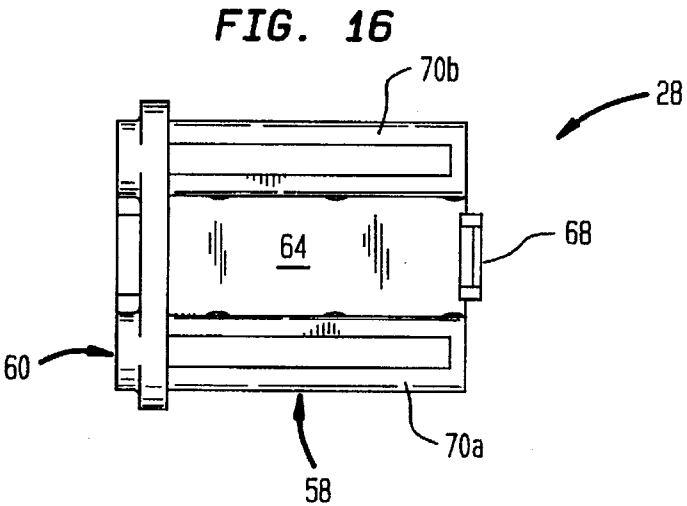
FIG. 16 is a bottom plan view of the cover shown in FIG. 13.
Figure 13:
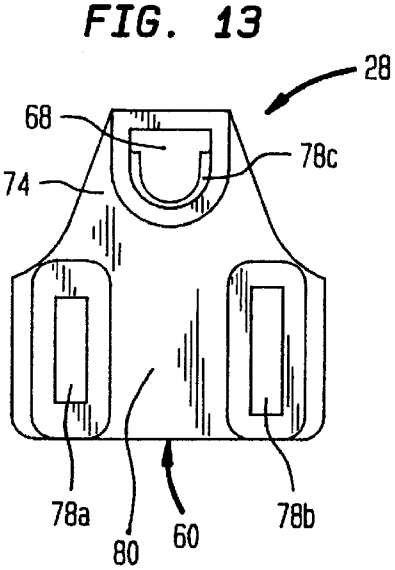
FIG. 13 is a front elevational view of a cover employed by the premold housing shown in FIGS. 1–7.

As shown in FIG. 12, the troughs 34*a*, 34*b* are also sized and shaped so as to inhibit the engaging portions 20*a*, 20*b*, from expanding beyond a predetermined limit as they receive male pins 39*a*, 39*b*, respectively, of a compatible male plug. More particularly, as the engaging portions 20*a*, 20*b* are engaged by the male pins 39*a*, 39*b*, the troughs 34*a*, 34*b* orient the engaging portions 20*a*, 20*b*, in a predetermined expanded position for purposes to be discussed hereinafter.

Figure 10:
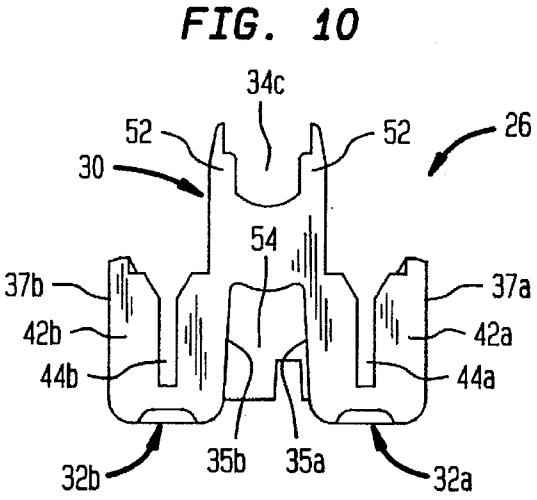
FIG. 10 is a rear elevational view of the body shown in FIG. 8.
Figure 9:
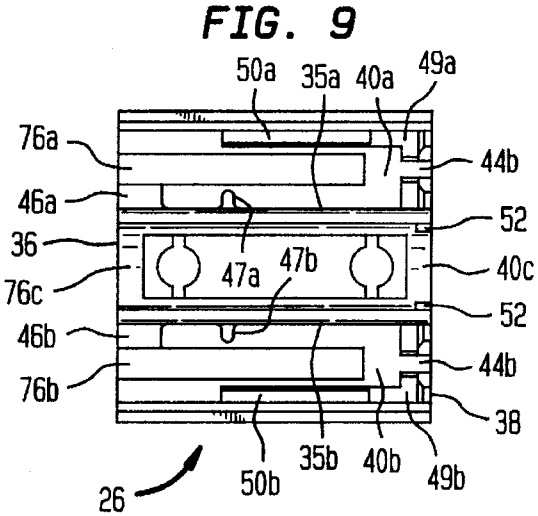
FIG. 9 is a top plan view of the body shown in FIG. 8.

Referring to FIGS. 2 and 8–10, rear ends 40*a*, 40*b* of the troughs 34*a*, 34*b*, respectively, are defined by retaining walls 42*a*, 42*b* having slots 44*a*, 44*b*, respectively, therein which communicate with the troughs 34*a*, 34*b*, respectively (see FIGS. 9 and 10). The slots 44*a*, 44*b* are sized and shaped so as to receive the connecting portions 24*a*, 24*b*, respectively, of the female contacts 18*a*, 18*b* (see FIGS. 3, 4 and 11). Once the connecting portions 24*a*, 24*b* are received in the slots 44*a*, 44*b*, the rear ends 40*a*, 40*b* of the troughs 34*a*, 34*b* are substantially obstructed (i.e., sealed) for purposes to be discussed hereinafter. With the engaging portions 20*a*, 20*b* of the female contacts 18*a*, 18*b* being positioned within the troughs 34*a*, 34*b* and with the connecting portions 24*a*, 24*b* being positioned in the slots 44*a*, 44*b*, the crimp ends 22*a*, 22*b* extend outwardly from the rear end 38 of the body 26 (see FIGS. 3, 4, 6 and 11), whereby they are exposed for crimping to electrical wires (not shown).

With reference to FIGS. 2 and 8–10, the troughs 34*a*, 34*b* of the side portions 32*a*, 32*b* also include retaining extensions 46*a*, 46*b*, respectively, which extend thereinto from the inner walls 35*a*, 35*b*, respectively, and which are located at the front end 36 of the body 26. The retaining extensions 46*a*, 46*b* restrict the female contacts 18*a*, 18*b*, respectively, from moving toward the front end 36 of the body 26 as a compatible male plug (not shown) is disengaged from the female receptacle 10 (see FIG. 12). The troughs 34*a*, 34*b* also include locking lips 50*a*, 50*b*, respectively, (see FIGS. 8 and 9), which project from the outer walls 37*a*, 37*b*, respectively, toward the troughs 34*a*, 34*b*, respectively, for purposes to be discussed hereinafter. Retaining ribs 47*a*, 47*b*, which project from the inner walls 35*a*, 35*b*, respectively, toward the troughs 34*a*, 34*b*, respectively, (see FIGS. 2, 8 and 9) and which extend vertically from open ends (i.e., top ends) of the troughs 34*a*, 34*b*, respectively, to closed ends (i.e., bottom ends) of the troughs 34*a*, 34*b*, respectively, are also provided for purposes to be described hereinafter. In addition, the troughs 34*a*, 34*b* are equipped with tabs 49*a*, 49*b* respectively, which extend thereinto from the outer walls 37*a*, 37*b*, respectively, of the side portions 32*a*, 32*b*, respectively (see FIGS. 8 and 9), for purposes to be described hereinafter.

With reference to FIG. 12, as the engaging portion 20*a* receives the male pin 39*a* of the male plug, the retaining rib 47*a*, the tab 49*a*, the outer wall 37*a* and the inner wall 35*a* of the side portion 32*a* cooperate in restricting the engaging portion 20*a* of the female contact 18*a* from expanding beyond the predetermined limit defined by the relative spacial positions of the retaining rib 47*a*, the tab 49*a*, the outer wall 37*a* and the inner wall 35*a*. As a result, the retaining rib 47*a*, the tab 49*a*, the outer wall 37*a* and the inner wall 35*a* function to urge the inner and outer legs 21*a*, 23*a* of the engaging portion 20*a* against the male pin 39*a* so as to grip the male pin 39*a* therebetween. Likewise, as the engaging portion 20*b* receives the male pin 39*b* of the male plug, the retaining rib 47*b*, the tab 49*b*, the outer wall 37*b* and the inner wall 35*b* of the side portion 32*b* cooperate in restricting the engaging portion 20*b* of the female contact 18*b* from expanding beyond the predetermined limit defined by the relative spacial positions of the retaining rib 47*b*, the tab 49*b*, the outer wall 37*b* and the inner wall 35*b*. As a result, the retaining rib 47*b*, the tab 49*b*, the outer wall 37*b* and the inner wall 35*b* function to urge the inner and outer legs 21*b*, 23*b* of the engaging portion 20*b* against the male pin 39*b* so as to grip the male pin 39*b* therebetween.

Referring to FIGS. 2 and 8–10, the central portion 30 of the body 26 includes a trough 34*c* extending from the front end 36 of the body 26 to the rear end 38 of the body 26. The trough 34*c* is sized and shaped so as to receive the engaging portion 20*c* of the female pin 18*c* (see FIGS. 11 and 12). A rear end 40*c* of the trough 34*c* includes a pair of opposing retaining extensions 52 extending into the trough 34*c* (see FIGS. 9 and 10). The rear end 40*c* of the trough 34*c* is sized and shaped so as to receive the connecting portion 24*c* of the female pin 18*c* between the retaining extensions 52 (see FIG. 11). With the engaging portion 20*c* of the female pin 18*c* positioned within the trough 34*c* and the connecting portion 24*c* positioned between the retaining extensions 52, the crimp end 22*c* extends outwardly from the rear end 38 of the body 26 (see FIGS. 3, 4 and 6), whereby it is exposed for crimping to an electrical wire (not shown).

Figure 8:
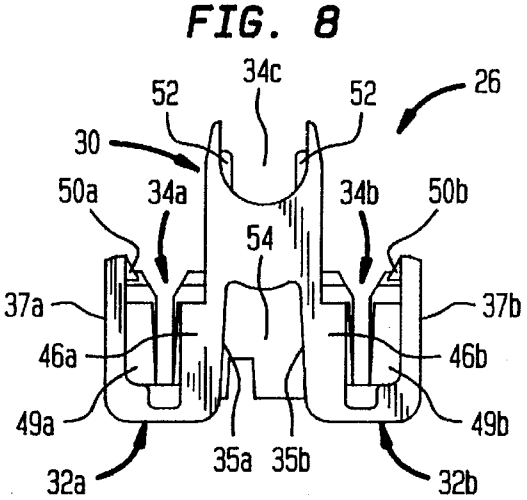
FIG. 8 is a front elevational view of a body employed by the premold housing shown in FIGS. 1–7.

Referring to FIGS. 3, 8 and 10, the body 26 also includes a reinforcing rib 54, which depends from the central portion 30 and which bridges a channel 56 formed between the side portions 32*a*, 32*b*. The reinforcing rib 54 functions to reinforce the body 26 so as to maintain a proper spacial relationship between the side portions 32*a*, 32*b*. As a result, proper spacial relationships between the female contacts 18*a*, 18*b* and the female pin 18*c* are maintained.

Figure 7:
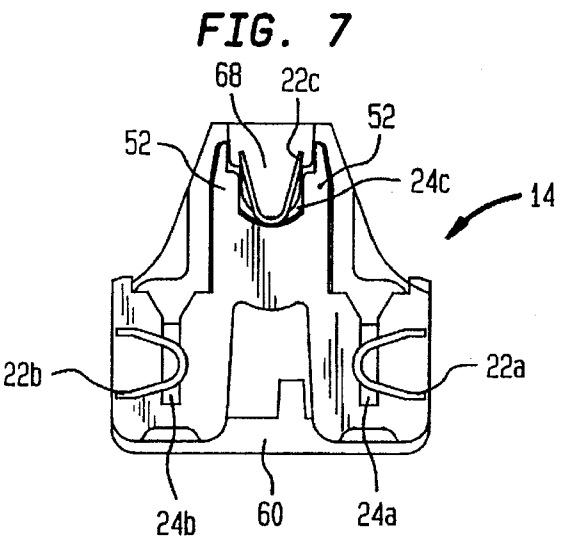
FIG. 7 is a rear elevational view of the premold housing shown in FIGS. 1 and 2.
Figure 6:
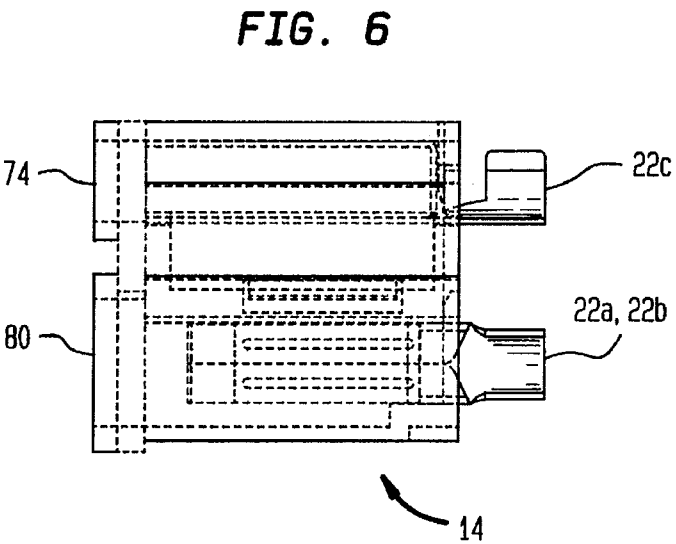
FIG. 6 is a side elevational view of the premold housing shown in FIGS. 1 and 2.

With reference to FIGS. 2 and 13–16, the cover 28 includes a cap 58 and a facial plate 60 depending from a front end 62 of the cap 58. The cap 58 includes a cavity 64 (see FIGS. 15 and 16) extending from the front end 62 of the cap 58 to a rear end 66 of the cap 58 and being sized and shaped so as to receive the central portion 30 of the body 26 (see FIGS. 3 and 4). The cap 58 also includes a tongue 68 which depends from the rear end 66 of the cap 58. The tongue 68 is sized and shaped so as to substantially obstruct (i.e., seal) the rear end 40*c* of the trough 34*c* of the central portion 30 of the body 26, when the cover 28 is engaged with the body 26 to form the premold housing 14, for purposes to be discussed hereinafter. The cap 58 also includes side walls 69*a*, 69*b* provided with shoulders 70*a*, 70*b* which extend substantially perpendicularly from the side walls 69*a*, 69*b*, respectively. The shoulders 70*a*, 70*b* are provided with notches 72*a* (see FIGS. 2 and 15), 72*b* (see FIGS. 14 and 15) sized and shaped so as to receive the locking lips 50*a*, 50*b*, respectively, of the side portions 32*a*, 32*b*, respectively, such that the cover 28 can be snap-fitted onto the body 26 to form the premold housing 14 (see FIGS. 4 and 7). Further, the shoulders 70*a*, 70*b* are sized and shaped so as to be received in the troughs 34*a*, 34*b*, respectively, of the side portions 32*a*, 32*b*, respectively (see FIGS. 4 and 7), whereby they also cooperate to substantially obstruct (i.e., seal) the rear ends 40*a*, 40*b* of the troughs 34*a*, 34*b* (see FIGS. 4 and 7).

Figure 5:
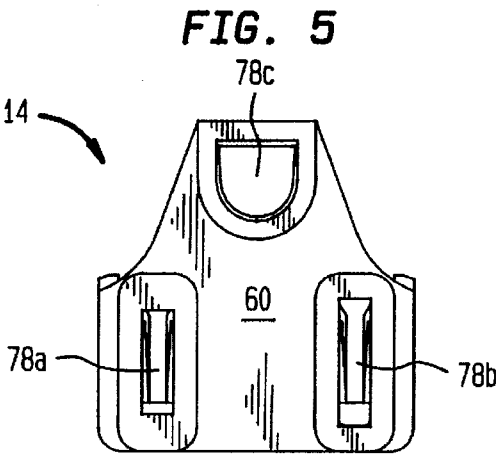
FIG. 5 is a front elevational view of the premold housing shown in FIGS. 1 and 2.

With reference to FIGS. 2, and 13–16, the facial plate 60 of the cover 28 includes an upper portion 74 sized and shaped so as to substantially obstruct the front end 62 of the cap 58. As a result, when the cover 28 is snap-fitted onto the body 26, the upper portion 74 of the facial plate 60 substantially obstructs a front end 76*c* of the trough 34*c*. The upper portion 74 includes a hole 78*c* which is in communication with the cavity 64. When the female receptacle 10 is formed, the hole 78*c* is in communication with the trough 34*c* and the opening 16*c* of the female receptacle 10 such that a ground pin of a compatible male plug can be engaged with the female pin 18*c* (see FIGS. 1 and 5). Similarly, the facial plate 60 includes a lower portion 80 which depends from the upper portion 74 and which is sized and shaped so as to substantially obstruct the front end 36 of the body 26 when the cover 28 is snap-fitted onto the body 26. More particularly, when the premold housing 14 is formed, front ends 76*a*, 76*b* of the troughs 34*a*, 34*b*, respectively, are substantially obstructed by the lower portion 80. The lower portion 80 also includes holes 78*a*, 78*b*. When the female receptacle 10 is formed, the holes 78*a*, 78*b* communicate with the troughs 34*a*, 34*b*, respectively, and with the openings 16*a*, 16*b*, respectively, of the female receptacle 10 such that male pins of a compatible male plug can be engaged with the female contacts 18*a*, 18*b*, respectively (see FIGS. 1 and 5).

To form the female receptacle 10, the premold housing 14 is assembled. More particularly, the engaging portions 20*a*, 20*b* of the female contacts 18*a*, 18*b*, respectively, and the engaging portion 20*c* of the female pin 18*c* are inserted into the troughs 34*a*, 34*b*, 34*c*, respectively, of the body 26, the connecting portions 24*a*, 24*b* of the female contacts 18*a*, 18*b*, respectively, being positioned in the slots 44*a*, 44*b*, respectively. With the crimp ends 22*a*, 22*b* of the female contacts 18*a*, 18*b*, respectively, and the crimp end 22*c* of the female pin 18*c* extending outwardly from the rear end 38 of the body 26, the cover 28 is aligned with the body 26. The body 26 and the cover 28 are then pressed against each other, allowing the locking lips 50*a*, 50*b* of the side portions 32*a*, 32*b*, respectively, to snap into the notches 72*a*, 72*b*, respectively, thereby forming the premold housing 14, which is substantially enclosed (see FIGS. 3, 4 and 5–7). After electrical wires are crimped to the crimp ends 22*a*, 22*b*, 22*c*, the premold housing 14 is overmolded by a conventional method, thereby forming the female receptacle 10 (see FIG. 1). Once formed, the female receptacle 10 can be used in the same manner as any equivalent conventional female receptacle.

It should be appreciated that the present invention provides many advantages over conventional overmolded female receptacles. For instance, through the cooperation between the female contacts 18*a*, 18*b* and their corresponding retaining ribs 47*a*, 47*b* and tabs 49*a*, 49*b*, the female receptacle 10 exhibits enhanced retention capacity (i.e., gripping force), as well as a prolonged useful operating life. In addition, because of the rigidity of the premold housing 14, it promotes the maintenance of proper spacial relationships between the female contacts 18*a*, 18*b* and the female pin 18*c* with respect to each other. Further, because the rigidity of the premold housing 14 remains substantially the same during fluctuations in temperature, the insertion and retraction forces are not dependent upon the type of material selected for the overmold; and, therefore, they remain substantially constant throughout the useful operating life of the female receptacle 10.

By enclosing the female contacts 18*a*, 18*b* and the female pin 18*c* in the premold housing 14, the female receptacle 10 is substantially flash-free. That is, molding material does not flash or otherwise intrude into the premold housing 14 during an overmolding process. As a result, the engaging portions 20*a*, 20*b* of the female contacts 18*a*, 18*b* and the engaging portion 20*c* of the female pin 18*c* are substantially free of molding material. Accordingly, the problem of discontinuity associated with conventional overmolded female receptacles is substantially minimized.

The present invention also provides increased efficiency from a manufacturing standpoint. For instance, because the premold housing 14 is prepared prior to an overmolding process, the premold housing 14 can be quickly and easily loaded into a mold using an automated load bar which would be inserted into one or more of the holes 78*a*, 78*b*, 78*c* in the cover 28, thereby reducing the overall molding cycle time. Because the cover 28 is snap-fitted onto the body 26, the premold housing 14 offers resistance to separation when it is positioned on the load bar in preparation for an overmolding operation.

The present invention also provides increased cost effectiveness. For instance, because of the increased mold cavitation created by the premold housing 14, the amount of overmolding material required in making the female receptacle 10 is substantially reduced. Further, by the use of the premold housing 14, less expensive material (e.g., vinyl having a durometer measurement of about 80 durometer or less) can be used for the overmold.

FIGS. 17–22 depict a second embodiment of the present invention. Elements illustrated in FIGS. 17–22 which correspond, either identically or substantially, to the elements described above with respect to the embodiment of FIGS. 1–16 have been designated by corresponding reference numerals increased by one hundred. Unless otherwise stated, the embodiment of FIGS. 17–22 is constructed and assembled in the same basic manner as the embodiment of FIGS. 1–16.

Figure 17:
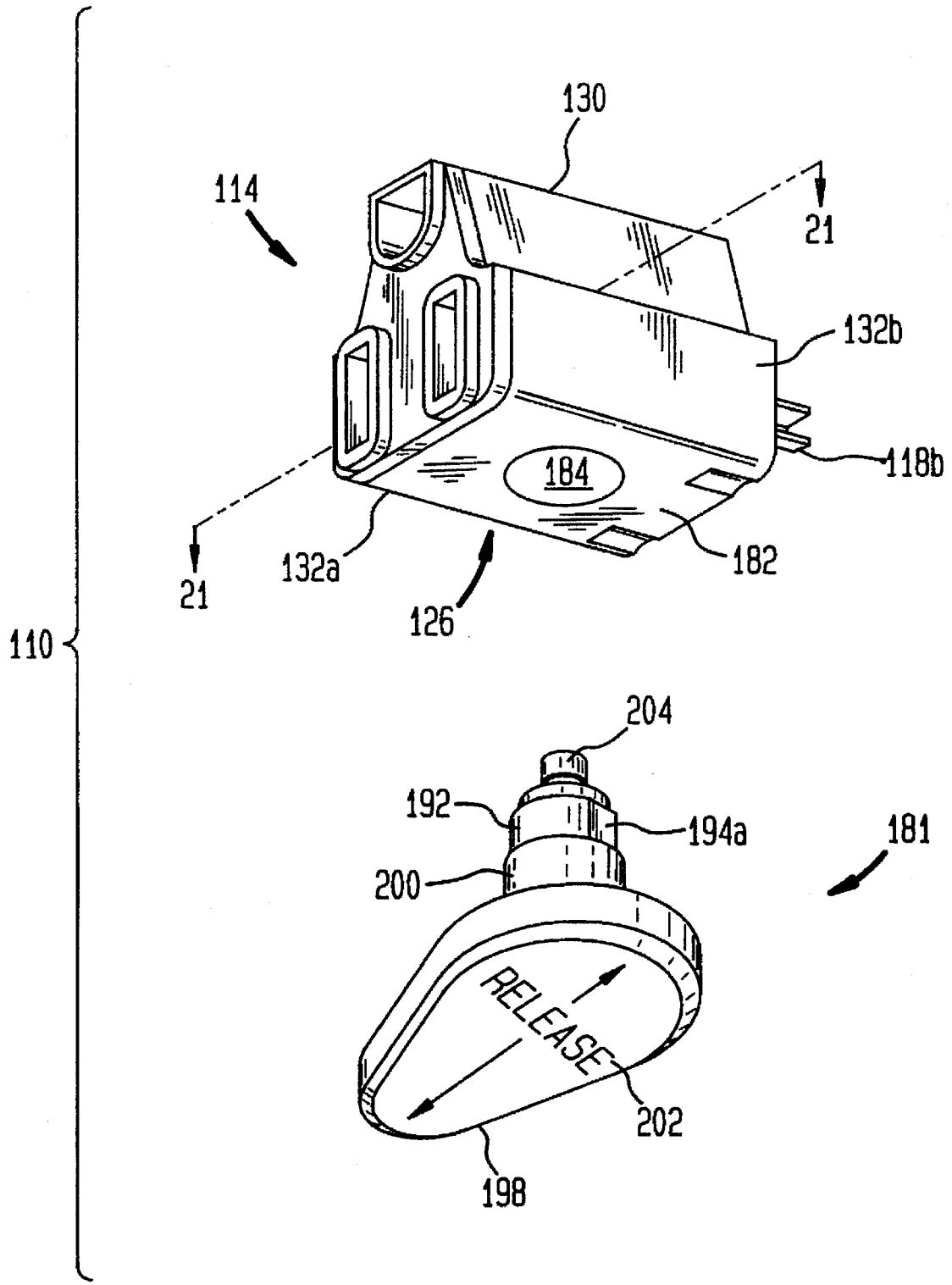
FIG. 17 is a partially exploded perspective view, looking from below, of a female receptacle constructed in accordance with a second embodiment of the present invention.

With reference to FIG. 17, a female receptacle 110 includes a premold housing 114 and a locking member 181 engageable with the premold housing 114. More particularly, the premold housing 114 includes a body 126 having a bottom side 182 which extends from a side portion 132*a* of the premold housing 114 to an opposite side portion 132*b* of the premold housing 114 and which includes an aperture 184 formed therein. The premold housing 114 also includes a central portion 130 having a hole 186 formed on a lower side 188 of the central portion 130 (see FIGS. 18–20). In addition, the premold housing 114 is provided with a bore 190 extending from the aperture 184 to the hole 186 for purposes to be discussed hereinafter (see FIGS. 18 and 19).

Figure 20:
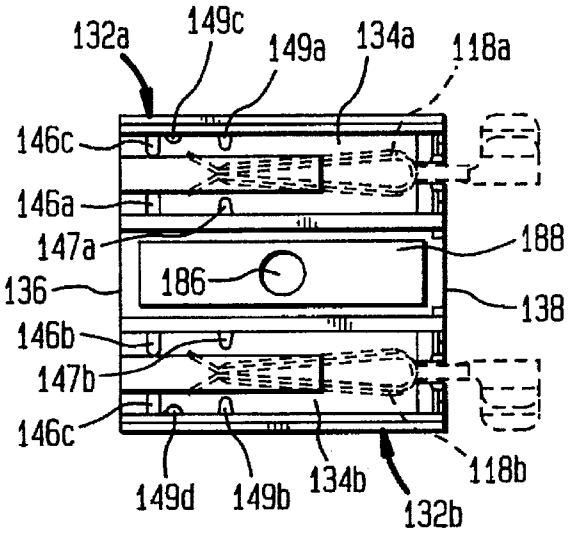
FIG. 20 is a top plan view of the body shown in FIG. 19, except that female contacts, which are illustrated in phantom, are positioned in the body.

Referring to FIG. 20, the side portions 132*a*, 132*b* include troughs 134*a*, 134*b* sized and shaped so as to receive clothes-pin type metal female contacts 118*a*, 118*b*, respectively. The side portions 132*a*, 132*b* are provided with a plurality of ribs 146*a*, 147*a* and ribs 146*b*, 147*b*, respectively, which project from inner walls of the side portions 132*a*, 132*b*, respectively, and which extend vertically between open ends (i.e., top ends) of the troughs 134*a*, 134*b*, respectively, and closed ends (i.e., bottom ends) of the troughs 134*a*, 134*b*, respectively. The side portions 132*a*, 132*b* also include ribs 146*c*, 149*a*, 149*c* and ribs 146*c*, 149*b*, 149*d*, respectively, which project from outer walls of the side portions 132*a*, 132*b*, respectively, and which extend vertically from the open ends to the closed ends. The ribs 147*a*, 149*a*, 149*c* and the ribs 147*b*, 149*b*, 149*d* perform the same basic function performed by the retaining ribs 47*a*, 47*b*, respectively, and the tabs 49*a*, 49*b*, respectively, of the female receptacle 10 illustrated in FIGS. 1–16 (i.e., they function to exert a substantially constant gripping force on associated male pins connected to the female contacts 118*a*, 118*b*, respectively). Similarly, the ribs 146*a*, 146*c* and the ribs 146*b*, 146*d* perform the same basic function performed by the retaining extensions 46*a*, 46*b*, respectively, of the female receptacle 10 illustrated in FIGS. 1–16 (i.e., they function to restrict the female contacts 118*a*, 118*b*, respectively, from moving toward a from end 136 of the body 126 as a compatible male plug (not shown) is disengaged from the female receptacle 110).

Figure 19:
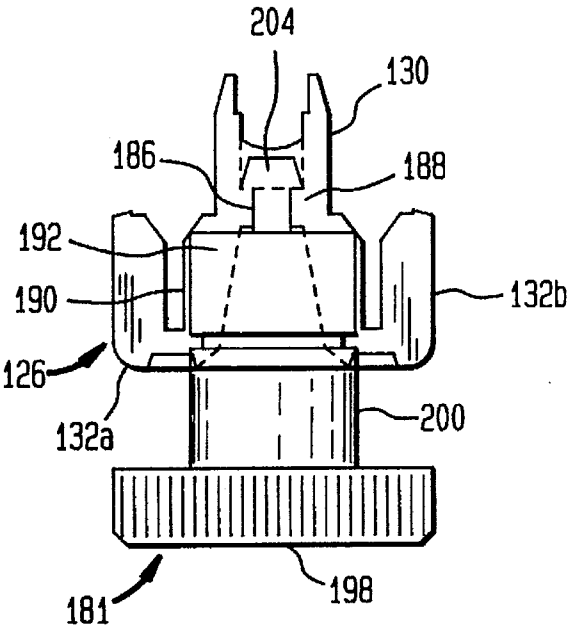
FIG. 19 is a rear elevational view of a body employed by the female receptacle shown in FIGS. 17 and 18.
Figure 18:
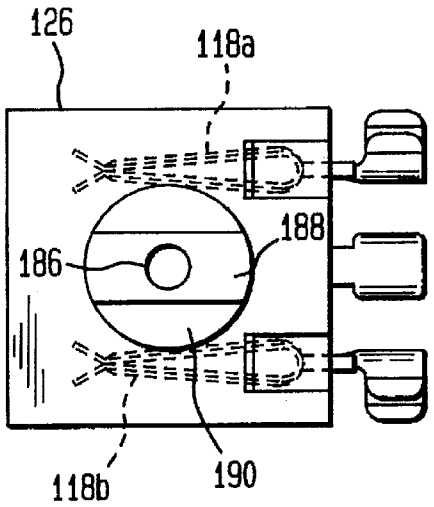
FIG. 18 is a bottom plan view of the female receptacle shown in FIG. 17, except that a locking member employed by the female receptacle is not illustrated.
Figure 21:
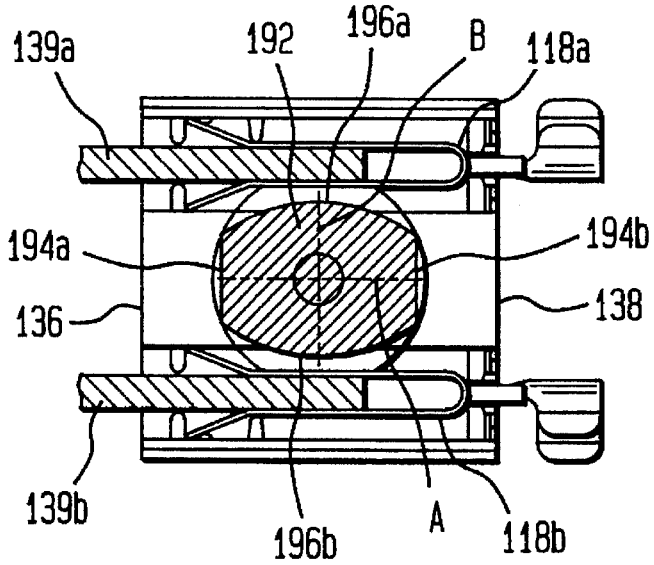
FIG. 21 is a view, taken along a section line 21—21 and looking in the direction of the arrows, of the female receptacle shown in FIG. 17, except that the female contacts are in an expanded position assumed when they are engaged by male pins of compatible male plug and that the locking member is in its unlocked position.
Figure 22:
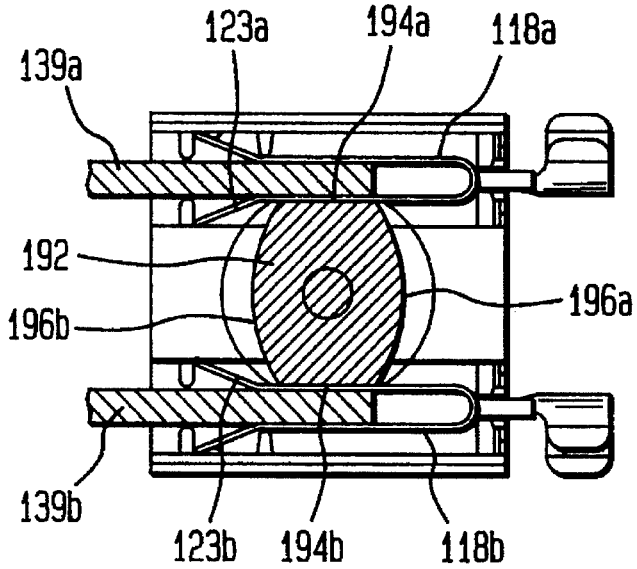
FIG. 22 is a view similar to FIG. 21, except that the locking member is in its locked position.

With reference to FIG. 17, the locking member 181 includes a cam 192 rotatably mounted in the bore 190 between the female contacts 118*a*, 118*b* for purposes to be discussed hereinafter (see FIGS. 19 and 21). More particularly, the cam 192 has an elliptical shape and a pair of flat sides 194*a*, 194*b* at opposing distal ends thereof. The cam 192 also has a major axis A, which extends substantially perpendicularly to the flat sides 194*a*, 194*b* of the cam 192, and a minor axis B, which extends between opposing proximal ends 196*a*, 196*b* of the cam 192 and which is substantially perpendicular to the major axis A (see FIG. 21). The length of the major axis A (i.e., the distance measured between the flat sides 194*a*, 194*b*) is generally greater than the distance measured between the female contacts 118*a*, 118*b*, while the length of the minor axis B (i.e., the distance measured between the proximal ends 196*a*, 196*b*) is generally smaller than the distance measured between the female contacts 118*a*, 118*b* (see FIG. 21). The locking member 181 also includes a handle 198 at one end thereof for rotating the cam 192 and a stem 200 connecting the cam 192 to the handle 198. The handle 198 has an oblong shape and indicia 202 thereon for indicating the relative position of the handle 198 and therefore the cam 192. When the female receptacle 110 is formed by overmolding the premold housing 114 in the manner described above in connection with the embodiment of FIG. 1–16, the stem 200 extends through the overmold (not shown) so as to position the handle 198 outside of the overmold. The locking member 181 is also provided with a mounting latch 204 which is positioned at an opposite end of the locking member 181 and which is sized and shaped so as to be inserted through the hole 186 of the central portion 130 in a snap-fitting manner, for removably and rotatably mounting the locking member 181 in the premold housing 114. When the locking member 181 is mounted in the premold housing 114, it is rotatable between its unlocked position, in which the major axis A is oriented substantially parallel to the longitudinal axis of the body 126 extending between the front end 136 of the body 126 and a rear end 138 of the body 126 (see FIG. 21), and its locked position, in which the major axis A is oriented substantially perpendicular to the longitudinal axis of the body 126 (see FIG. 22).

In use, the female receptacle 110 is used in the same basic as the female receptacle 10 illustrated in FIGS. 1–16, except that by using the female receptacle 110 shown in FIGS.

17–22, the female receptacle 110 can be locked to an associated male plug. More particularly and referring to FIG. 21, with the locking member 181 being in its unlocked position, an associated male plug is plugged into the female receptacle 110. Because in its unlocked position the cam 192 is spaced from the female contacts 118*a*, 118*b* and therefore does not exert any locking forces against same, corresponding male pins 139*a*, 139*b* of an associated male plug (not shown) can be inserted into and retracted from the female contacts 118*a*, 118*b*, respectively, of the female receptacle 110 in a normal manner. After the male plug is plugged into the female receptacle 110, the handle 198 is rotated 90 degrees, thereby moving the cam 192 from its unlocked position to its locked position (see FIG. 22). More particularly, in its locked position, the flat sides 194*a*, 194*b* of the cam 192 are in contact with inner legs 123*a*, 123*b*, respectively, of the female contacts 118*a*, 118*b*, respectively, and urge the female contacts 118*a*, 118*b*, respectively, into locking engagement with the male pins 139*a*, 139*b*, respectively. As a result, the retraction of the male plug from the female receptacle 110 is inhibited. In order to retract the male plug from the female receptacle 110, the handle 198 is counter-rotated 90 degrees, thereby moving the cam 192 into its unlocked position and releasing the male pins 139*a*, 139*b* from their locking engagement with the female contacts 118*a*, 118*b*, respectively.

It should be noted that the locking member 181 can be provided with numerous modifications and variations. For instance, the latch 204 may be replaced with other mounting mechanisms for rotatably mounting the locking member 181 in the premold housing 114. In addition, the cam 192 may have other shapes. It should also be noted that the ribs 147*a*, 147*b*, 149*a*, 149*b*, 149*c*, 149*d* may be replaced with other mechanisms for cooperating to provide a substantially constant gripping force on a male plug connected to the female receptacle 110.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

We claim:

1. In a female receptacle adapted for electrical connection to a male plug and having an overmold, a pair of clothes-pin type metal female contacts and a D-shaped metal female pin, the improvement comprising a premold positioned in said overmold for housing said female contacts and said female pin, said premold including a body, which has first receiving means for receiving one of said pair of female contacts, second receiving means for receiving another of said pair of female contacts and third receiving means for receiving said female pin, and a cover, releasably mounted on said body in a snap-fit manner, for covering said first, second and third receiving means, said first and second receiving means including cooperating means for cooperating with said female contacts to exert a substantially constant gripping force on male pins of a male plug connected to said female receptacle.

2. The improved female receptacle of claim 1, wherein said premold is made of nylon; and wherein said overmold is made of vinyl, which has a durometer measurement of about 80 durometer or less.

3. The improved female receptacle of claim 1, further comprising locking means for locking said female receptacle to a male plug connected to said female receptacle.

4. The improved female receptacle of claim 3, wherein said locking means includes a cam movable between a first position, in which said cam urges said female contacts into locking engagement with corresponding male pins of the male plug, and a second position, in which said cam does not urge said female contacts into locking engagement with the corresponding male pins of the male plug.

5. A premold for a female receptacle adapted for electrical connection to a male plug, comprising a body having first receiving means for receiving one clothes-spin type metal female contact, second receiving means for receiving another clothes-pin type metal female contact, and third receiving means for receiving a D-shaped metal female pin; a cover, releasably mounted on said body, for covering said first, second and third receiving means; and gripping means for exerting a substantially constant gripping force on male pins of a male plug connected to said premold.

6. The premold of claim 5, wherein said first receiving means includes a first trough extending from one end of said body to an opposite end of said body; wherein said second receiving means includes a second trough extending from said one end of said body to said opposite end of said body; and wherein said third receiving means includes a third trough extending from said one end of said body to said opposite end of said body.

7. The premold of claim 6, wherein said first trough is formed in a first side portion of said body; wherein said second trough is formed in a second side portion of said body, said first and second side portions being on opposite sides of said premold; and wherein said third trough is formed in a central portion of said body, said central portion being intermediate said first and second side portions.

8. The premold of claim 7, wherein said body further includes a first retaining wall, which substantially obstructs one end of said first trough adjacent said one end of said body and which has a slot formed therein, and a second retaining wall, which substantially obstructs one end of said second trough adjacent said one end of said body and which has a slot formed therein.

9. The premold of claim 8, wherein said body includes reinforcing means for reinforcing said body.

10. The premold of claim 9, wherein said reinforcing means includes a rib depending from said central portion of said body and connecting said first and second side portions.

11. The premold of claim 6, wherein said cover includes a cap, which is releasably mounted on said body, and a face plate depending from said cap and sized and shaped so as to substantially obstruct said opposite end of said body.

12. The premold of claim 11, wherein said cover includes a tongue depending from said cap and sized and shaped so as to substantially obstruct one end of said third trough adjacent said one end of said body.

13. The premold of claim 12, wherein said cover includes a notch; and wherein said body further includes a locking lip engageable with said notch so as to releasably lock said cover onto said body in a snap-fit manner.

14. The premold of claim 6, wherein said gripping means includes a first tab formed in said first trough and a second tab formed in said second trough.

15. The premold of claim 14, wherein said gripping means further includes a first rib formed in said first trough and a second rib formed in said second trough.

16. The premold of claim 5, further comprising locking means for locking said female receptacle to a mate plug connected to said female receptacle.

17. The premold of claim 16, wherein said locking means includes a cam movable between a first position, in which said cam urges said female contacts into locking engagement with corresponding male pins of the male plug, and a second position, in which said cam does not urge said female contacts into locking engagement with the corresponding male pins of the male plug.

18. A female receptacle adapted for electrical connection to a male plug, comprising a premold, which includes a body having first receiving means for receiving a first clothes-pin type metal female contact, second receiving means for receiving a second clothes-pin type metal female contact, and third receiving means for receiving a D-shaped metal female pin, and a cover, releasably mounted on said body, for covering said first, second and third receiving means; said first and second receiving means including cooperating means for cooperating with said female contacts to exert a substantially constant gripping force on male pins of a male plug connected to said female receptacle; and an overmold which houses said premold, as well as said first and second female contacts and said female pin.

19. The female receptacle of claim 18, wherein said body and said cover are rigid so as to maintain predetermined spacial relationships between said first and second female contacts and said female pin.

20. The female receptacle of claim 19, wherein said cover cooperates with said body such that at least a portion of each of said first and second female contacts and at least a portion of said female pin are enclosed within said premold.

21. The female receptacle of claim 18, further comprising locking means for locking said female receptacle to a male plug connected to said female receptacle.

22. The female receptacle of claim 21, wherein said locking means includes a cam movable between a first position, in which said cam urges said female contacts into locking engagement with corresponding male pins of the male plug, and a second position, in which said cam does not urge said female contacts into locking engagement with the corresponding male pins of the male plug.

* * * * *